US008388364B2

(12) United States Patent
Kikuchi

(10) Patent No.: US 8,388,364 B2
(45) Date of Patent: Mar. 5, 2013

(54) JOINT CONNECTOR AND BUSBAR

(75) Inventor: Takahiro Kikuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/313,167

(22) Filed: Dec. 7, 2011

(65) Prior Publication Data

US 2012/0184144 A1 Jul. 19, 2012

(30) Foreign Application Priority Data

Jan. 18, 2011 (JP) ..... 2011-007578

(51) Int. Cl.
*H01R 13/64* (2006.01)

(52) U.S. Cl. ..... 439/251; 439/507

(58) Field of Classification Search ..... 439/251, 439/507, 511

See application file for complete search history.

(56) References Cited

U.S. PATENT DOCUMENTS

| | | | | |
|---|---|---|---|---|
| 4,453,792 | A * | 6/1984 | Bright et al. | 439/251 |
| 7,384,319 | B2 * | 6/2008 | Kirstein et al. | 439/839 |
| 7,806,711 | B2 * | 10/2010 | Andersen et al. | 439/251 |
| 2002/0115355 | A1 | 8/2002 | Yoshida et al. | |

FOREIGN PATENT DOCUMENTS

JP 2009-16292 1/2009

* cited by examiner

*Primary Examiner* — Tulsidas C Patel
*Assistant Examiner* — Travis Chambers
(74) *Attorney, Agent, or Firm* — Gerald E. Hespos; Michael J. Porco

(57) ABSTRACT

A joint connector has a housing (1) with cavities (3) into which female terminal fittings (2) are insertable, and a busbar (5) to be mounted in the housing (1). The busbar (5) has tabs (6) to be connected to the respective female terminal fittings (2) and adapted to short the female terminal fittings (2) to each other. The busbar (5) includes a base (15) used to mount the busbar (5) into the housing (1) and the tabs (6) are cantilevered from the base (15). The base (15) includes resilient legs (17) for allowing displacements of the tabs (6) in a direction crossing a longitudinal direction of the tabs (6). The tabs (6) can be displaced by displacements of the resilient legs (17) to absorb a misalignment between the tab pieces (6) and the female terminal fittings (2).

7 Claims, 9 Drawing Sheets

JOINT CONNECTOR AND BUSBAR

BACKGROUND OF THE INVENTION

1. Field of the Invention

The invention relates to a joint connector and to a busbar.

2. Description of the Related Art

Japanese Unexamined Patent Publication No. 2009-16292 discloses a joint connector with a housing that has side by side cavities. A busbar is press fit into the housing and has tabs projecting into the cavities. Female terminal fittings can be inserted into the cavities and connect to the tabs so that the female terminal fittings are shorted to each other.

The female terminal fitting and the tab may be misaligned due to a variation in the mount position of the busbar, a variation in the manufacturing of the female terminal fittings or the like. Thus, the tip of the tab may contact a projection on the inner surface of a ceiling plate of the female terminal fitting. A clearance can be provided between the female terminal fitting and the inner surface of the cavity so that the entire female terminal fitting can be displaced to avoid the above-described contact.

Miniaturization of terminal fittings has created a demand for miniaturized housings. Hence, almost no clearances can be formed between female terminal fittings and inner surfaces of cavities. Accordingly, a risk of contact has increased recently and an effective measure against this contact is needed.

The invention was completed in view of the above situation and an object thereof is to avoid the contact of a contact piece with a terminal fitting.

SUMMARY OF THE INVENTION

The invention relates to a joint connector with a housing that has cavities for receiving terminal fittings. A busbar is mounted in the housing and has connection pieces to be connected electrically to the respective terminal fittings. The busbar includes a base that is used to mount the busbar into the housing and connection pieces cantilever from the base. The base includes at least one spring that allows displacement of the connection pieces in a direction crossing a longitudinal direction of the connection pieces.

The terminal fitting that is being inserted into the cavity may not align perfectly with the connection piece. However, the spring permits the connection piece to displace sufficiently to correct the misalignment between the connection piece and the terminal fitting and to ensure a smooth connection.

At least one spring preferably is provided for each tab. Accordingly, misalignment for the tabs can be absorbed individually.

The springs preferably are arranged at opposite widthwise sides of extensions of axes of the respective tabs. Accordingly, the tabs can be displaced in a well-balanced manner without twisting.

The spring preferably comprises two resilient legs arranged at opposite sides of an extension of an axis of the connection piece at each of the opposite lateral edges of the base along a longitudinal direction of the base. The resilient legs in each pair may extend in substantially opposite directions along an axial direction of the connection piece.

The housing preferably has a busbar mounting portion into which the busbar is mounted. The base preferably is supported by the resilient legs while being lifted from the busbar mounting portion. Accordingly, misalignment of the tabs and the female terminal fittings can be absorbed by resilient deformation of the respective resilient legs.

The busbar mounting portion preferably is formed over substantially the entire width of the housing. Locking projections are formed at positions on a surface of the busbar mounting portion and are fit into corresponding mounting holes of the busbar to retain the busbar.

The cavity preferably is formed with at least one guide that is tapered or inclined to reduce the clearance to the terminal fitting gradually or stepwise and at least one accommodating portion is formed behind or adjacent to the guide for accommodating a terminal connecting portion of the terminal fitting.

The invention also relates to a busbar to be mounted in a housing with cavities that can receive terminal fittings. The busbar has a base used to mount the busbar into the housing and connection pieces are cantilevered from the base. The connection pieces can be connected to the respective terminal fittings for shorting the terminal fittings to each other. The base includes springs for allowing displacements of the connection pieces in a direction crossing a longitudinal direction of the connection pieces.

At least one spring preferably is provided for each connection piece. More particularly, the springs may be arranged at opposite widthwise sides of extensions of axes of the respective connection pieces.

The springs preferably comprise resilient legs arranged at opposite sides of an extension of an axis of the connection piece at each of the opposite lateral edges of the base along a longitudinal direction of the base portion.

The paired resilient legs preferably extend resiliently deformably in opposite directions along an axial direction of the connection piece.

These and other objects, features and advantages of the invention will become more apparent upon reading the following detailed description of preferred embodiments and accompanying drawings.

DETAILED DESCRIPTION OF THE PREFERRED EMBODIMENT

Figure 1:
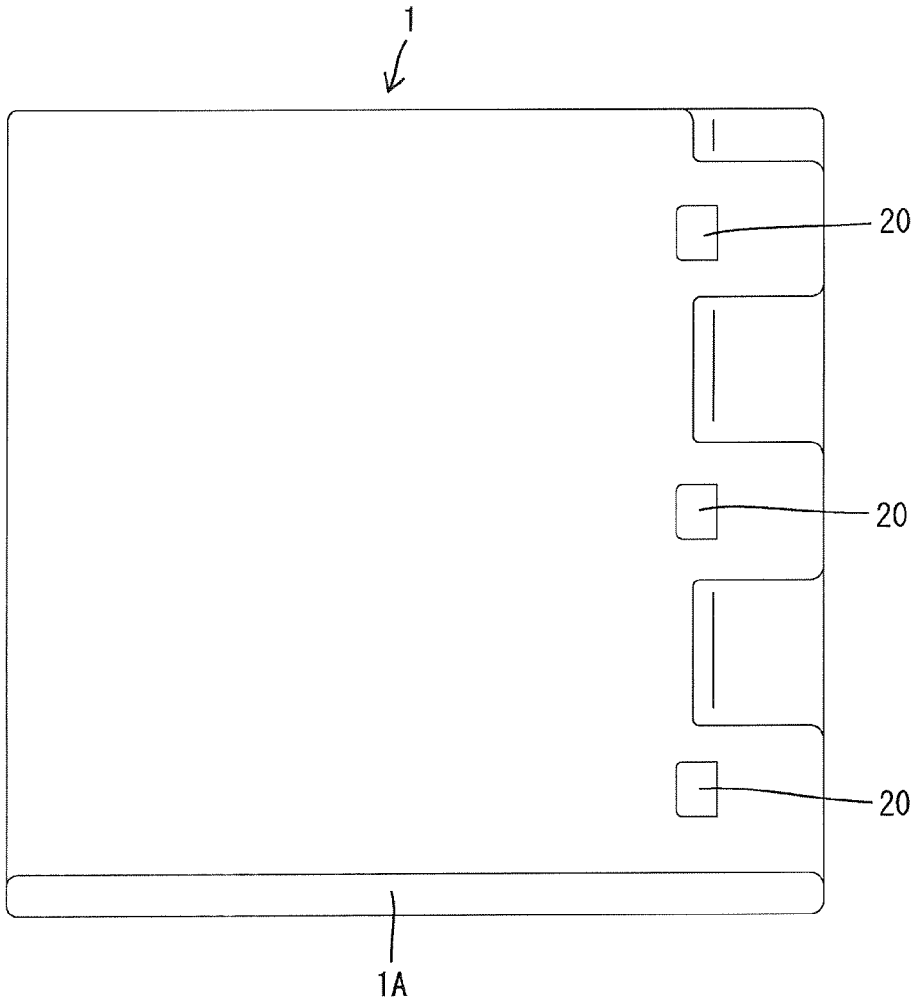
FIG. 1 is a plan view of a connector housing.
Figure 2:
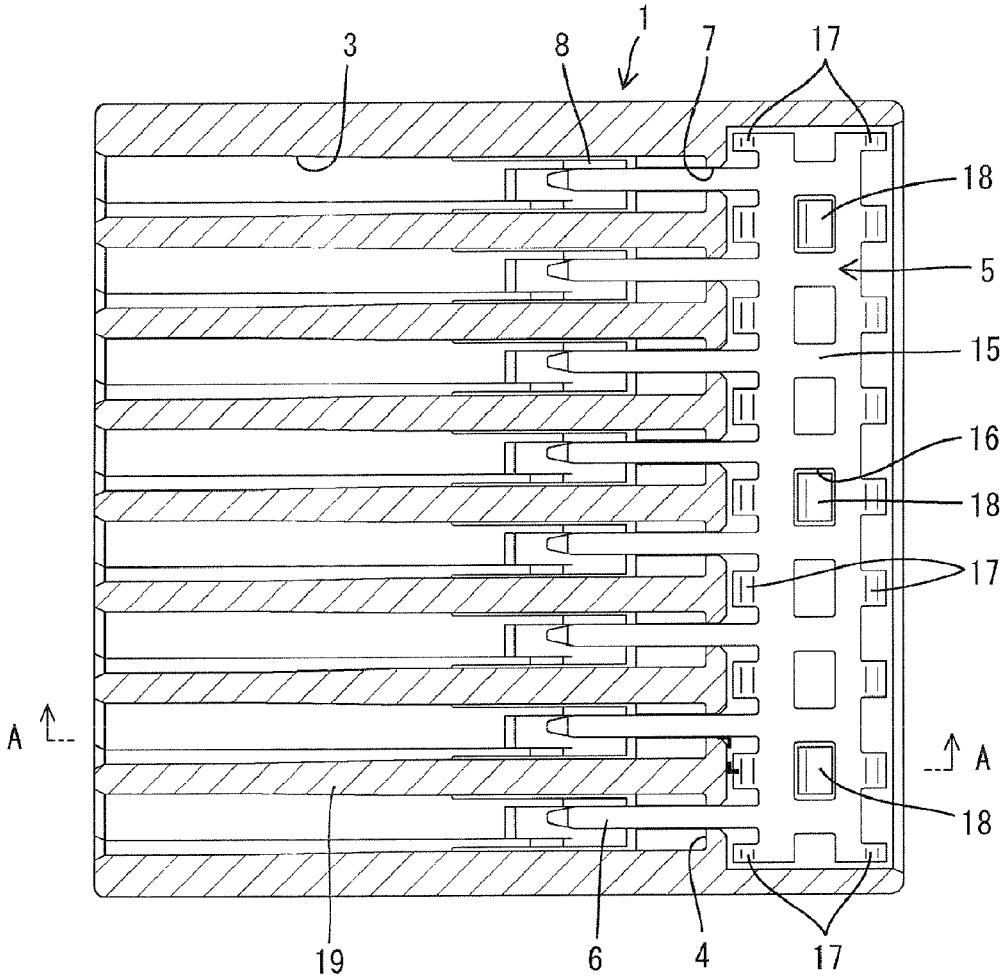
FIG. 2 is a plan view in section of a joint connector.

A joint connector in accordance with the invention includes a housing identified by the numeral 1 in FIGS. 1-9. The housing 1 is made e.g. of synthetic resin. A projection 1A is formed at one lateral edge of the upper surface of the housing 1 and projects over substantially the entire length for preventing erroneous connection and for guiding a connecting operation. Side by side cavities 3 are formed in the housing 1 and have openings at the front (left in FIG. 2) of the housing 1 for receiving female terminal fittings 2. A front stop surface 4 is formed at the back end of each cavity 3 and can define a front end position when the female terminal fitting 2 is inserted. Each front stop surface 4 has a through window 7 for allowing penetration of a tab 6 of a busbar 5.

A locking lance 8 is arranged at a bottom surface of each cavity 3 near the front end. The locking lance 8 is exposed at the outer surface of the housing 1 and is surrounded by a slit 8A so as to be resiliently deformable in and out. The locking lance 8 can engage a lance hole 10 formed in a terminal connecting portion 9 of the female terminal fitting 2 to retain the female terminal fitting 2 that has been inserted to a proper depth in the cavity 3.

A part of the bottom surface of each cavity 3 before the locking lance 8 is slightly lower and have laterally spaced supporting projections 22 for supporting a front end portion of the terminal connecting portion 9.

The bottom surface of each cavity 3 is substantially flat and at the same height substantially from the entrance to the locking lance 8. On the other hand, entrance areas of the ceiling and opposite side surfaces of each cavity 3 for the female terminal fitting 2 are widened to define an introducing portion 11 that ensures a sufficient clearance around to the terminal connecting portion 9. A guide 12 is substantially continuous with the introducing portion 11 and is tapered to gradually or stepwise reduce the clearance to the female terminal fitting 2. An accommodating portion 13 is formed at a part of the cavity 3 behind the guide 12 for accommodating the terminal connecting portion 9. This accommodating portion 13 has a rectangular or polygonal shape substantially in conformity with the terminal connecting portion 9 and is dimensioned to accommodate the entire terminal connecting portion 9 with almost no clearance therebetween.

A busbar mounting portion 14 used to mount the busbar 5 is provided in a part of the interior of the housing 1 behind the front stop surfaces 4 of the respective cavities 3. The busbar 5 is formed by press-working, stamping, bending, folding and/or embossing an electrically conductive metal plate material. The busbar 5 includes a base 15 used to mount the busbar 5 into the housing 1, tabs 6 to be connected to the respective female terminal fittings 2 and resilient legs 7 enabling displacements of the tabs 6.

The tabs 6 can project into the cavities 3 through the windows 7 with substantially the entire busbar 5 mounted in the busbar mounting portion 14. In a state before the female terminal fittings 2 are inserted, the respective tabs 6 are almost in contact with the upper and left and right edges of the respective through windows 7. However, the lower edges of the through windows 7 are aligned at the height of the bottom surface of the busbar mounting portion 14. Thus, specified clearances are formed between the tabs 6 and the lower edges of the through windows 7. That is, the tabs 6 penetrate through the through windows 7 with their downward displacements allowed.

The base 15 is substantially in the form of a band strip extending in a longitudinal direction of the busbar mounting portion 14, and the tabs 6 project laterally at substantially equal intervals from one of the lateral edges of the base 15. Mounting holes 16 are formed in the base 15 and are arranged substantially side by side in the longitudinal direction. The mounting holes 16 are rectangular and are located in intermediate positions between adjacent tabs 6.

Springs are provided at the front and rear edges (opposite lateral edges along the longitudinal direction) of the base 15 for displacing the tabs 6 in the height direction of the base 15 and substantially perpendicular to an extending direction of the respective tabs 6. The spring is formed by two resilient legs 17 arranged at opposite widthwise sides of each mounting hole 16 and at front and rear edges of the base 15. Thus, the resilient legs 17 are provided at opposite sides of an extension of each tab 6 at each of the front and rear edges of the base 15. The front and rear resilient legs 17 are cantilevered forward and back from the front and rear edges of the base 15 and extend obliquely down toward their free ends. Thus, the base 15 and the tabs 16 are lifted from the bottom surface of the busbar mounting portion 14. However, the base 15 and the tabs 16 can be displaced down in the height direction since the free ends of the paired resilient legs 17 are displaced while sliding out in contact with the bottom surface of the busbar mounting portion 14.

Note that, in this embodiment, the mounting hole 16 and the resilient legs 17 are cut to be substantially halved at each of the opposite widthwise ends of the busbar 5.

The busbar mounting portion 14 is formed over substantially the entire width of the housing 1 and is open along one surface extending in the longitudinal direction. The busbar 5 can be mounted into the busbar mounting portion 14 through this opening. Locking projections 18 are formed at three positions on a bottom surface 14A of the busbar mounting portion 14 and are used to mount the busbar 5. The locking projections 18 are located in a central part of the busbar mounting portion 14 in forward and backward directions and are arranged on extensions of partition walls 19 near the widthwise opposite ends and in intermediate positions of the partition walls 19 of the respective cavities 3 in the width direction. The locking projections 18 are to be fit into the corresponding mounting holes 16 of the busbar 5 to retain the entire busbar 5. More specifically, the outer surfaces of the respective locking projections 18 from the opening side of the busbar mounting portion 14 to the tops of the locking projections 18 are formed into upwardly inclined surfaces 18A, and the opposite surfaces are formed into vertical surfaces 18B. Note that, mold removal holes 20 are formed at three positions of the outer surface of the housing 1 to form the vertical surfaces 18B of the respective locking projections 18.

Figure 3:
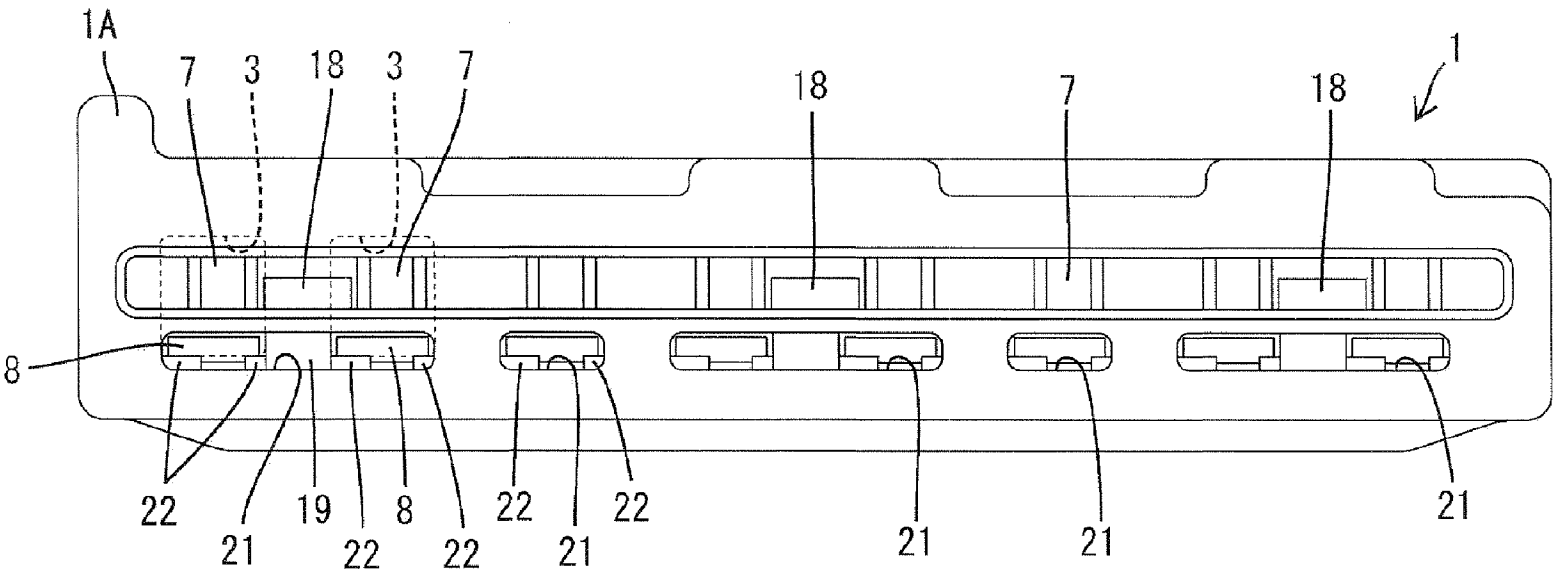
FIG. 3 is a rear view of the housing when viewed from a side from which a busbar is inserted.
Figure 4:
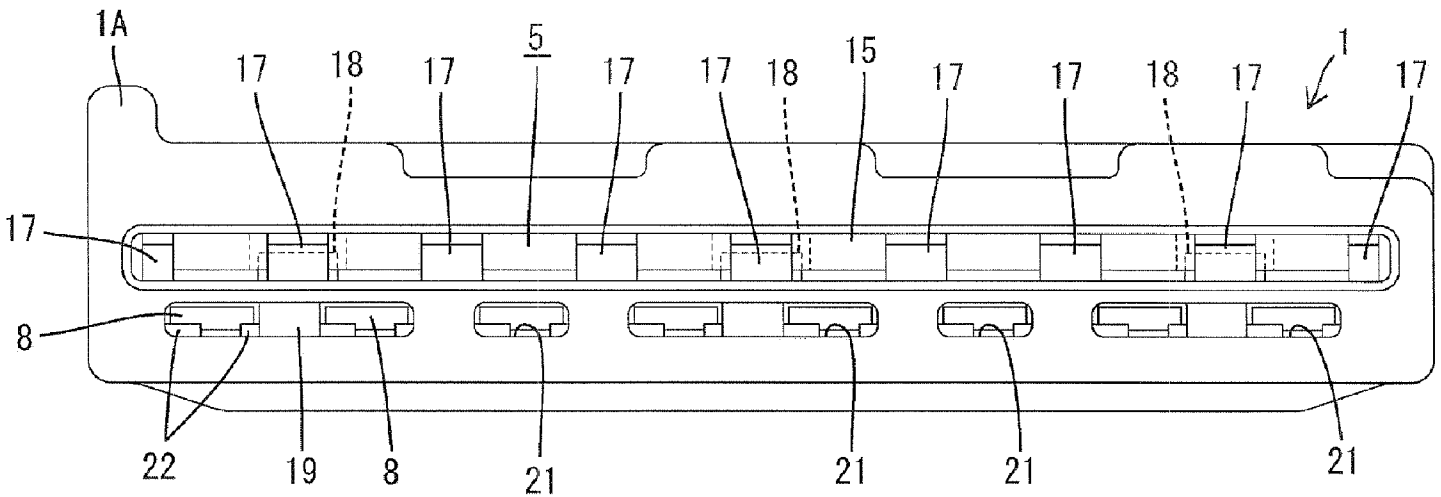
FIG. 4 is a rear view showing a state where the busbar is inserted.
Figure 5:
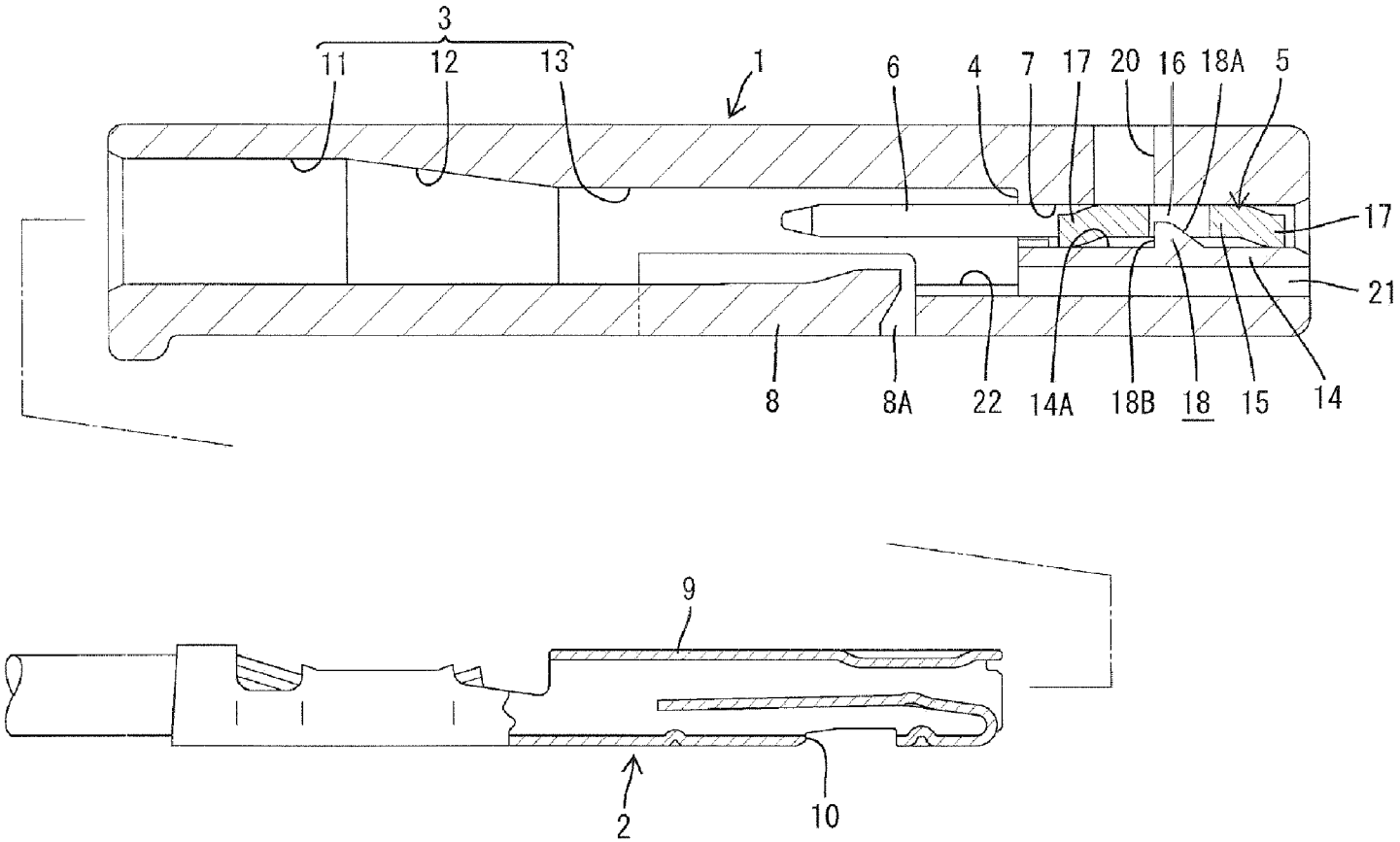
FIG. 5 is a section along A-A of FIG. 2 showing a state before female terminal fittings are inserted.
Figure 6:
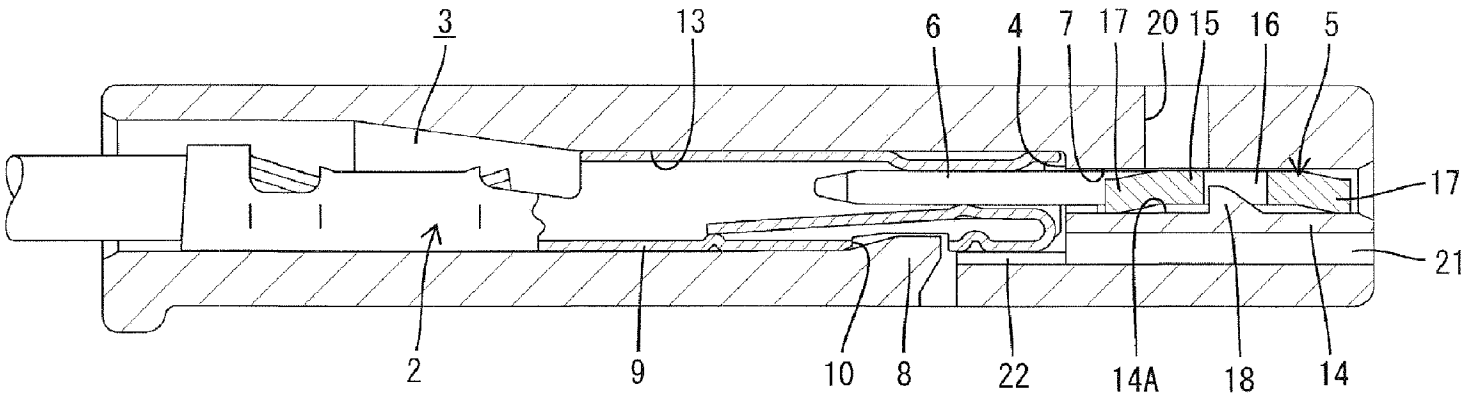
FIG. 6 is a side view in section showing a state after the female terminal fittings are inserted.
Figure 7:
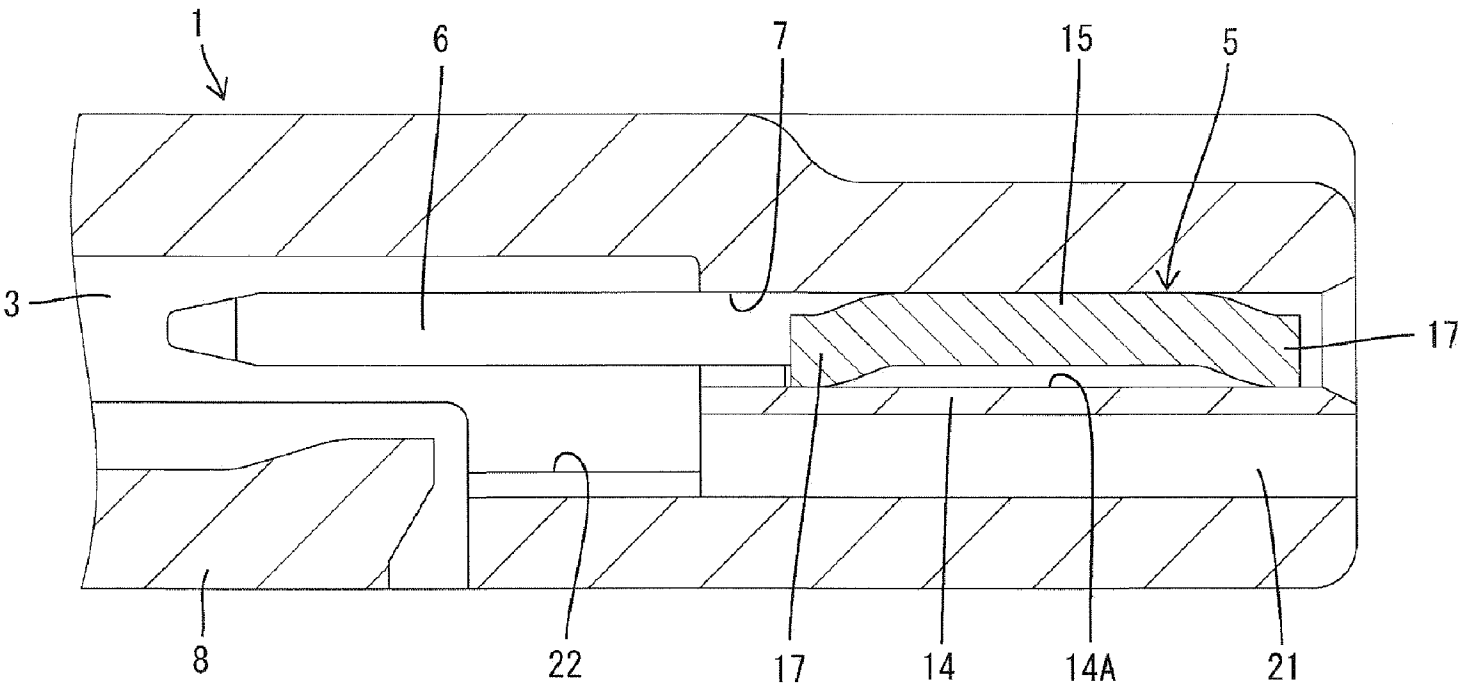
FIG. 7 is an enlarged section showing a natural state of resilient legs.
Figure 8:
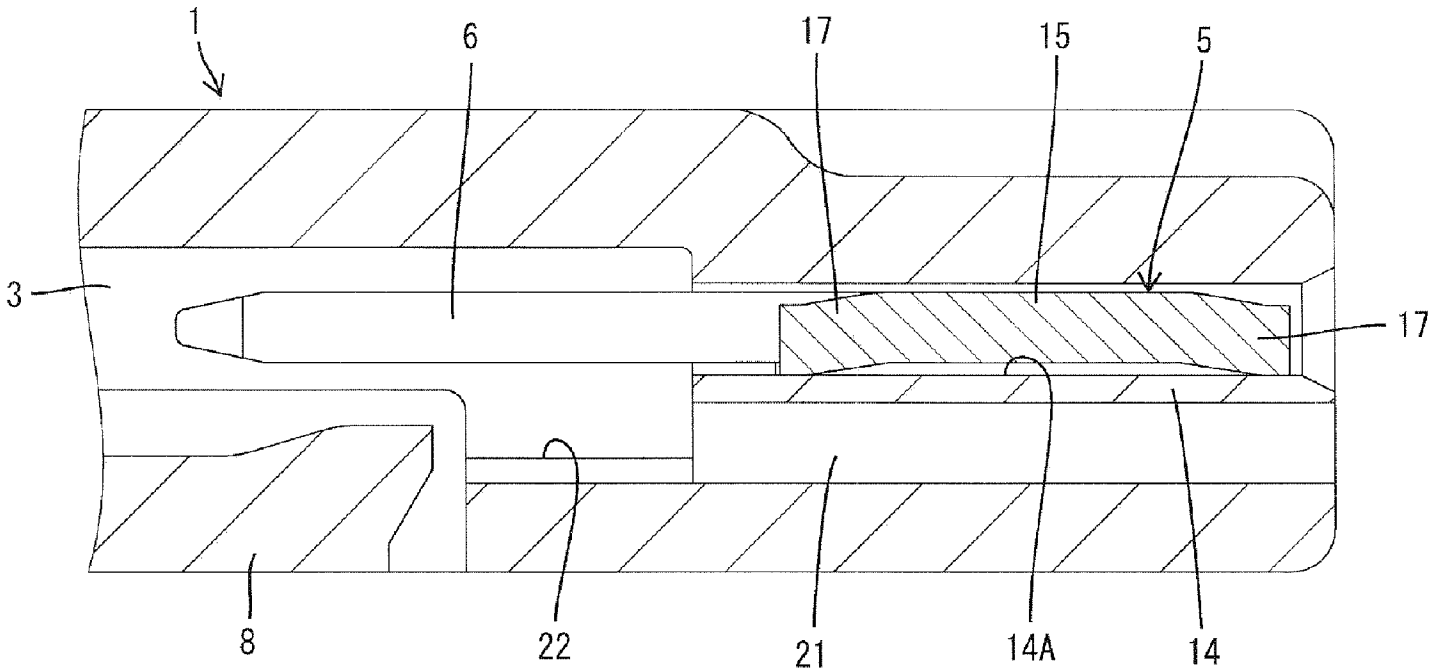
FIG. 8 is an enlarged section showing a resiliently deformed state of the resilient legs.

Mold removal spaces 21 are formed below the busbar mounting portion 14 in the housing 1 and are left upon forming the supporting projections 22. The mold removal spaces 21 are arranged in correspondence with the respective cavities 3. As shown in FIG. 3, the mold removal spaces 21 arranged at the left and right sides of a vertical axis passing through each locking projection 18 are united with each other to form a wide mold removal space 21. The wide mold removal spaces 21 below the locking projections 18 function as deformation spaces for resiliently deforming parts of the bottom surfaces 14A of the busbar mounting portion 14 around the locking projections 18.

Figure 9:
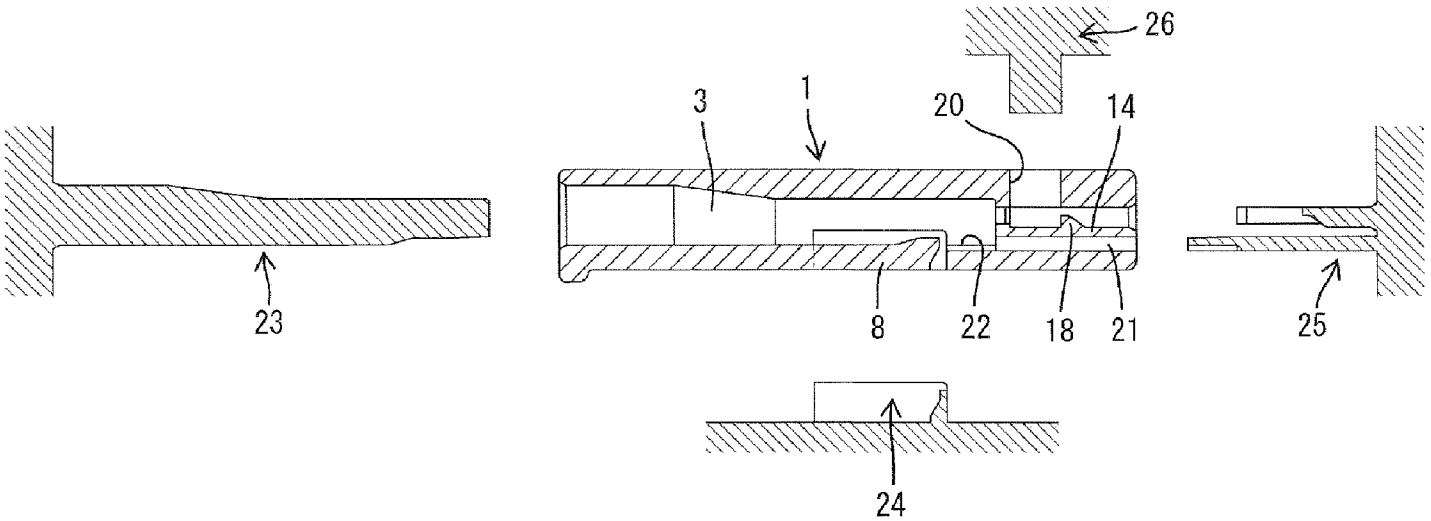
FIG. 9 is a section showing a mold structure for forming the housing.

The housing 1 is formed by four forming molds 23 to 26, as shown in FIG. 9. More particularly, the housing 1 is formed by a first forming mold 23 for entirely forming the respective cavities 3, a second forming mold 24 for forming the front end surfaces and opposite side surfaces of the locking lances 8, a third forming mold 25 for forming the busbar mounting portion 14, the supporting projections 22 and the like and a fourth forming mold 26 for forming the vertical surfaces 18B of the locking projections 18.

The entire busbar 5 is placed in a substantially horizontal posture and caused to face the opening of the busbar mounting portion 14 with the tips of the respective tabs 6 in the lead. The busbar 5 then is pushed so that the tabs 6 are projected into the respective cavities 3 through the windows 7. While the resilient legs 17 located to substantially face the respective locking projections 18 are passing the inclined surfaces 18A of the locking projections 18, the parts around the locking projections 18 including the locking projections 18 out of the bottom surface 14A of the busbar mounting portion 14 are deformed resiliently toward the mold removal spaces 21. Thus, the resilient legs 17 can move over the inclined surfaces 18A of the locking projections 18. When the resilient legs 17 move over the locking projections 18, the respective locking projections 18 return at once and are fit simultaneously into and engaged with the mounting holes 16. In this way, the entire busbar 5 is mounted and retained in the busbar mounting portion 14. In this state, the base 15 and the tabs 6 are lifted away from the bottom surface 14A of the busbar mounting portion 14 as described above.

The female terminal fittings 2 then are inserted into the respective cavities 3 through the introducing portions 11. Initial insertion into the cavities 3 is done easily since there are large clearances between the introducing portions 11 and the terminal connecting portions 9 of the female terminal fittings 2. Thereafter, the female terminal fittings 2 move forward to the accommodating portions 13 via the guides 12 that gradually or stepwise reduce the clearances. During this process, the female terminal fittings 2 resiliently deform the locking lances 8. When the female terminal fittings 2 are inserted to a proper depth in the respective cavities 3, the locking lances 8 resiliently return to be engaged with the lance holes 10 of the female terminal fittings 2. In this way, the female terminal fittings 2 are held and retained in the respective cavities 3 and the tabs 6 enter the terminal connecting portions 9 to establish an electrically connected state.

A misaligned state where the axial centers of the tab 6 and the terminal connecting portion 9 are not aligned might occur due to a mounting error of the busbar 5 or another factor. In such a case, for example, the tip of the tab 6 may contact a part of the ceiling wall in the terminal connecting portion 9. Such a displacement cannot be absorbed in the female terminal fitting 2 since there is almost no clearance between the terminal connecting portion 9 of the female terminal fitting 2 and the inner walls of the cavity 3 as described above. However, a push-down or biasing force acts on the tip of the tab 6 when the tab 6 comes into contact. Accordingly, the corresponding resilient legs 17 paired at the front and/or rear in correspondence with this tab 6 are deformed resiliently. That is, the tips of both resilient legs 17 are displaced while sliding forward and back in contact with the bottom surface 14A of the busbar mounting portion 14. Thus, the base 15 is displaced down and the tab 6 also is displaced substantially parallel and downward. In this way, a correction is made to align the axial centers of the female terminal fitting 2 and the tab 6 as the connecting operation progresses so that a properly connected state is reached.

As described above, even if there is a misalignment in the height direction between the tab 6 and the terminal connecting portion 9, the tab 6 can be corrected to a height position where the axial centers substantially can be aligned by the spring action of the front and rear resilient legs 17. Accordingly, the tab 6 and the female terminal fitting 2 can be connected smoothly. Further, since the front and rear resilient legs 17 are provided for each tab piece 6 in this embodiment, there can be also obtained an effect of being able to individually cope with the misaligned state of the tab 6 and the female terminal fitting 2 and/or substantially stabilize the posture of the tab 6 at the time of a displacement by the support by the front and rear resilient legs 17. Further, in correcting a misalignment, the tab 6 does not undergo a pivotal displacement about its base end, but substantially undergoes a parallel displacement in the height direction. Therefore, the connecting parts of the terminals can come into surface contact to ensure a good electrically conductive state.

The invention is not limited to the above described and illustrated embodiment. For example, the following embodiments also are included in the scope of the invention.

Although the spring portions (resilient legs 17) of the busbar 5 are unitarily formed to the base 15 in the above embodiment, separate springs may be employed.

Although the connector of the type in which the busbar 5 is pushed from the lateral side of the housing 1 to be mounted is illustrated in the above embodiment, the busbar 5 can be easily mounted into the busbar mounting portion 14 from above if the housing 1 is of the type in which the busbar mounting portion 14 is entirely open upward. The respective cavities 3 may also formed to be open upward in such a housing 1 and a plurality of housings may be piled up like blocks.

Although the tabs 6 project only toward one side of the base portion 15 in the busbar 5 illustrated in the above embodiment, the busbar 5 may be such that the tab pieces 6 project toward both sides of the base portion 15. This means that the present invention can also be applied to an intermediate joint connector.

What is claimed is:

1. A joint connector, comprising:

a housing including cavities into which terminal fittings respectively are insertable; and a busbar including an elongate base mounted in the housing, the base having opposite lateral edges, connection pieces cantilevered from one of the lateral edges of the base and projecting respectively into the cavities for electrical connection to the respective terminal fittings for shorting the terminal fittings to each other, the base including resilient legs at each of the opposite lateral edges of the base and arranged at opposite sides of an extension of an axis of the connection pieces for allowing displacements of the connection pieces in a direction crossing a longitudinal direction of the connection pieces.

2. The joint connector of claim 1, wherein the resilient legs at the opposite lateral edges of the base extend in opposite directions along an axial direction of the connection pieces.

3. The joint connector of claim 1, wherein the cavity is formed with at least one guide tapered or inclined to gradually or stepwise reduce the clearance to the terminal fitting and wherein at least one accommodating portion for accommodating a terminal connecting us this portion of the terminal fitting is formed at a side of the cavity substantially adjacent to the guide.

4. The joint connector of claim 1, wherein a busbar mounting portion is formed in the housing into which the busbar is received, the base being supported by the resilient legs while being lifted from the busbar mounting portion.

5. The joint connector of claim 4, wherein the busbar mounting portion is formed over substantially the entire width of the housing, locking projections being formed on a surface of the busbar mounting portion and being fit into corresponding mounting holes of the busbar to retain the busbar.

6. A busbar for shorting a plurality of terminal fittings, comprising:

a substantially planar base with opposite front and rear ends;

substantially planar connection pieces cantilevered from the front end of the base and being substantially coplanar with the base; and springs cantilevered from the front and rear ends of the base and arranged at opposite sides of an extension of an axis of each of the connection pieces, the springs being aligned oblique to a plane defined by the base and the connection pieces to permit deflection of the base and the connection pieces relative to the springs.

7. The busbar of claim 6, wherein the springs all are cantilevered toward a same side of the plane defined by the base and the connection pieces.

* * * * *